US006779947B1

(12) United States Patent
Buchanan et al.

(10) Patent No.: US 6,779,947 B1
(45) Date of Patent: Aug. 24, 2004

(54) GATE SYSTEMS AND METHODS FOR REGULATING TIDAL FLOWS

(75) Inventors: Kevin Buchanan, P.O. Box 287, Burlington, WA (US) 98233; Percy N. Hazel, Bellingham, WA (US)

(73) Assignee: Kevin Buchanan, Burlington, WA (US)

( * ) Notice: Subject to any disclaimer, the term of this patent is extended or adjusted under 35 U.S.C. 154(b) by 0 days.

(21) Appl. No.: 10/647,083

(22) Filed: Aug. 21, 2003

(51) Int. Cl.[7] ..... E02B 7/40

(52) U.S. Cl. ..... 405/99; 405/96; 405/95; 405/94; 405/92; 405/100

(58) Field of Search ..... 405/87, 80, 92–97, 405/99, 100

(56) References Cited

U.S. PATENT DOCUMENTS

| | | | | |
|---|---|---|---|---|
| 401,788 A | | 4/1889 | McCloskey | |
| 1,276,053 A | | 8/1918 | Gottschalk | |
| 1,334,354 A | * | 3/1920 | Dodd | 405/99 |
| 1,634,697 A | | 7/1927 | Thorsby | |
| 2,176,522 A | * | 10/1939 | Brown | 137/527.6 |
| 3,006,150 A | | 10/1961 | Bannister | |
| 3,543,521 A | | 12/1970 | Aubert | |
| 3,733,830 A | * | 5/1973 | Jacobs | 405/94 |
| 3,952,522 A | * | 4/1976 | Shettel | 405/96 |
| 3,974,654 A | * | 8/1976 | Mirto, Jr. | 405/127 |
| 4,091,624 A | | 5/1978 | Steinke | |
| 4,114,381 A | * | 9/1978 | Lundh | 405/94 |
| 4,324,506 A | * | 4/1982 | Steinke | 405/96 |
| 4,503,881 A | | 3/1985 | Vecchio | |
| 4,600,222 A | | 7/1986 | Appling | |
| 4,877,352 A | | 10/1989 | Tuttle et al. | |
| 5,222,833 A | * | 6/1993 | Gorlov | 405/76 |
| 5,462,075 A | | 10/1995 | Persson | |
| 5,755,257 A | | 5/1998 | Feucht et al. | |
| 5,829,917 A | * | 11/1998 | Maudal | 405/52 |
| 6,478,954 B1 | | 11/2002 | Turner, Jr. et al. | |
| 6,485,231 B2 | | 11/2002 | Montgomery et al. | |

OTHER PUBLICATIONS

Jay Charland; "Tide Gate Modifications for Fish Passage and Water Quality Enhancement"; Paper for the Tillamook Bay National Estuary Project; Aug. 27, 1998; pp. 1–15.

Waterman Industries, Inc.; "SRT (Self–Regulating Tidegate) for Tidal Wetlands Preservation & Restoration"; Catalog; Nov., 2002; pp. 19–24.

Waterman Industries, Inc.; Drawing Nos. 98, 99 & 100; Nov./Dec., 2002; three (3) sheets.

* cited by examiner

*Primary Examiner*—Frederick L. Lagman
(74) *Attorney, Agent, or Firm*—Michael R. Schacht; Schacht Law Office, Inc.

(57) ABSTRACT

A tidal gate system for a regulating the flow of tidal waters between a first side and a second side of a main opening. The tidal gate system comprises a primary door member defining a regulated opening, a secondary door member sized and dimensioned to cover the regulated opening, a door float, and a regulation float Gravity biases the primary and secondary door members into their closed positions. The door float causes the secondary door assembly to move out of its closed position when a primary water level on the first side of the main opening exceeds a predetermined regulated opening level. The regulation float is operatively connected to the secondary door assembly such that the regulation float forces the secondary door assembly into its closed position when the primary water level exceeds a predetermined regulation float level.

21 Claims, 10 Drawing Sheets

GATE SYSTEMS AND METHODS FOR REGULATING TIDAL FLOWS

FIELD OF THE INVENTION

The present invention relates to systems and methods for controlling the flow of fluids and, more specifically, to systems and methods for regulating the flow of tidal waters through a conduit.

BACKGROUND OF THE INVENTION

The present invention is of particular significance when used to regulate the flow of tidal waters in a tideland environment, and that application will be described herein in detail. However, the present invention has broader application to any environment where regulation of water flow is desired. The scope of the present invention should thus be determined by the claims appended hereto and not the following detailed description of the invention.

The term "tideland" will be used herein to refer to land areas that are covered by salt water under certain tidal conditions. In many geographical regions, the size of tidelands has been reduced over the years, primarily through the use of dikes or levees that restrict the flow of tidal waters to predefined channels. More recently, efforts have been made to restore the flow of tidal waters into former tidelands. However, former tidelands are often now populated, and simply removing dikes or levees is not a viable alternative for reclaiming tidelands.

Instead, the reclamation of tidelands is now typically accomplished by breaching dikes or levees at critical locations such that tidal waters flow through these breaches into a desired portion of the reclaimed tidelands. For example, a pipe, culvert, or other conduit through a dike or levee may be configured to allow water to flow, under certain tidal conditions, between a main body of water and a connected stream. A gate assembly is typically placed at the outlet of the conduit to regulate the flow of tidal waters through the conduit. The flow of tidal waters into former tidelands, even if regulated with a gate assembly, encourages the growth of biological organisms (plants, fish, etc.) that are dependent upon tidal waters.

A gate assembly designed to regulate tidal flows should ideally be somewhat adjustable to accommodate different goals and tidal, seasonal, and weather conditions. A tidal gate assembly must be corrosion resistant and sufficiently rugged to operate unattended in potentially rough conditions.

From the foregoing, it should be apparent that the need exists for simple, rugged, and adjustable gate systems and methods for regulating the flow of tidal water through a conduit.

SUMMARY OF THE INVENTION

The present invention may be embodied as a tidal gate system and method for a regulating the flow of tidal waters between a first side and a second side of a main opening. The tidal gate system comprises a primary door member defining a regulated opening, a secondary door member sized and dimensioned to cover the regulated opening, a door float, and a regulation float. Gravity biases the primary and secondary door members into their closed positions. The door float causes the secondary door assembly to move out of its closed position when a primary water level on the first side of the main opening exceeds a predetermined regulated opening level. The regulation float is operatively connected to the secondary door assembly such that the regulation float forces the secondary door assembly into its closed position when the primary water level exceeds a predetermined regulation float level.

BRIEF DESCRIPTION THE DRAWING

DETAILED DESCRIPTION OF THE PREFERRED EMBODIMENTS

Figure 1:
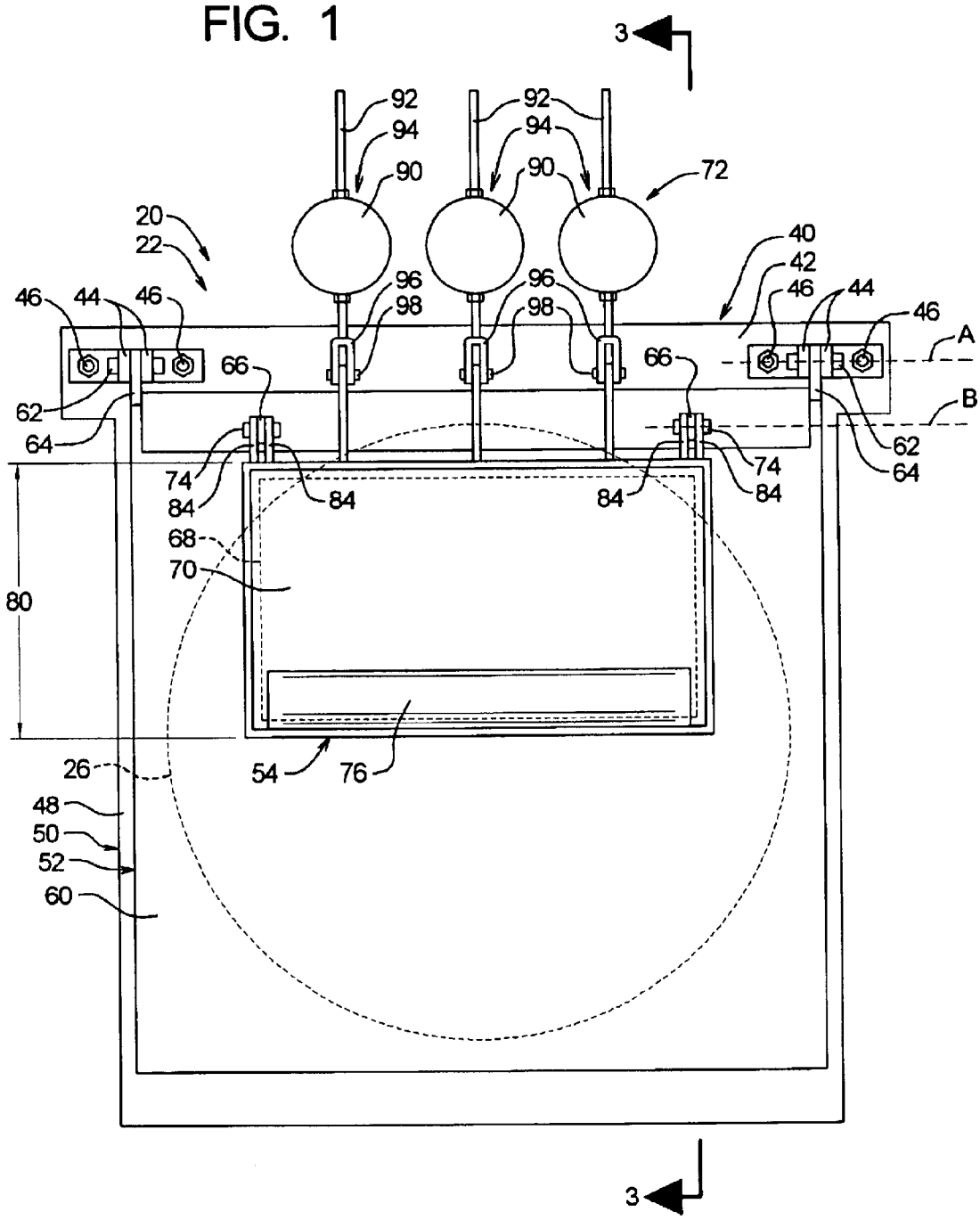
FIG. 1 is a front elevation view of a tidal gate assembly of a first embodiment of the present invention.
Figure 2:
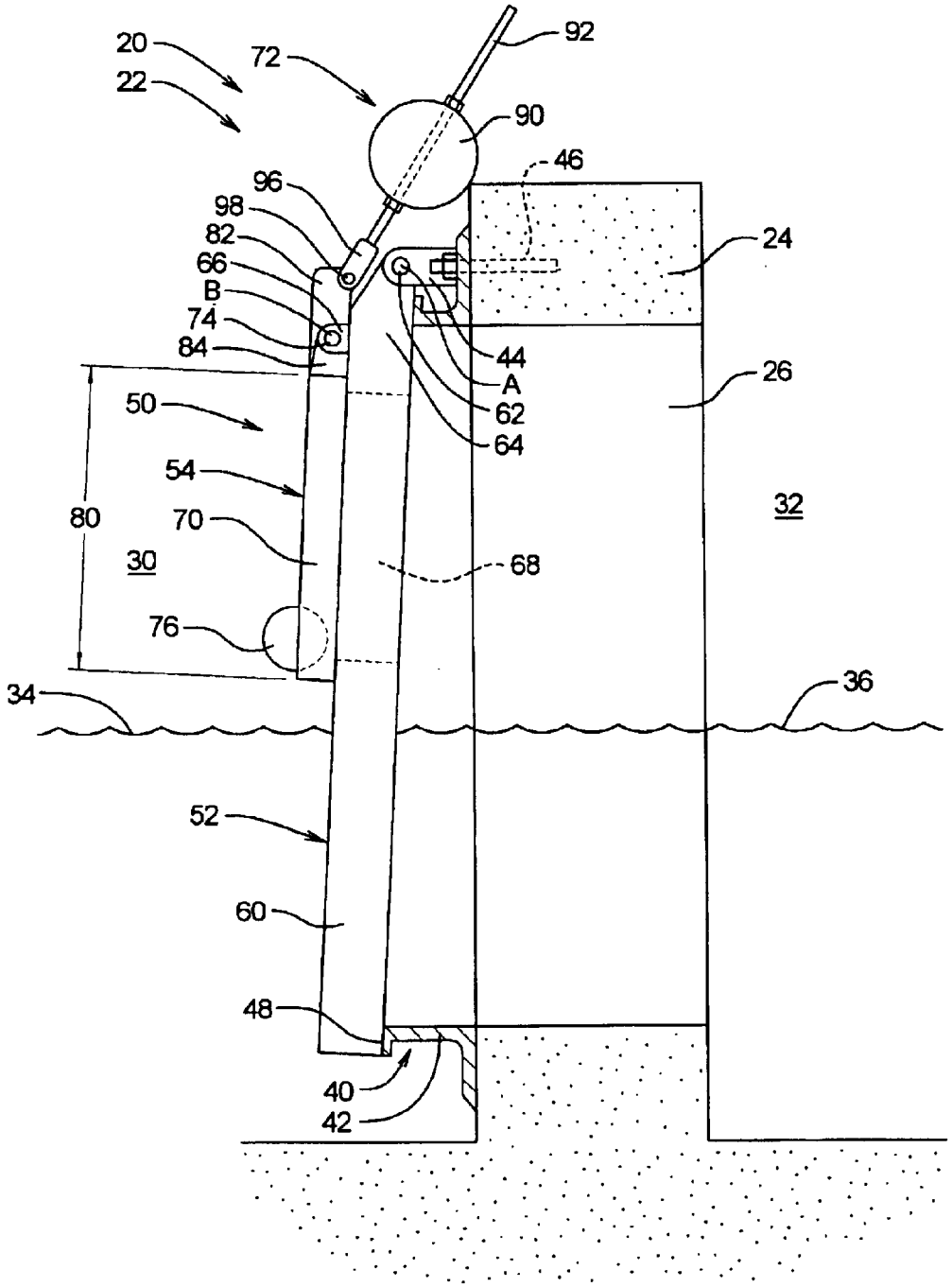
FIG. 2 is a side elevation view of the tidal gate assembly of FIG. 1.

Referring initially to FIGS. 1 and 2, depicted therein is a gate system 20 constructed in accordance with, and embodying, the principles of the present invention. The gate system 20 comprises a gate assembly 22 mounted on a conduit 24. The gate assembly 22 regulates the flow of water through an opening 26 defined by the conduit 24.

The gate assembly 22 defines a first side 30 and a second side 32. As shown in FIG. 2, a primary body of water represented by a primary water level 34 is located on the first side 30 of the gate assembly 22. A secondary body of water represented by a water level 36 may be located on the second side 32 of the gate assembly 22. The levels 34 and 36 of water vary significantly and rarely if ever will these levels 34 and 36 be exactly the same as shown in FIG. 2. The purpose of the gate assembly 22 is to regulate the flow of water between the primary and secondary bodies of water primarily based on the level 34 of the primary body of water and secondarily based on the level 36 of the secondary body of water.

The gate assembly 22 comprises a frame assembly 40 comprising a frame 42. One or more frame hinge ears 44 extend from the frame 42 to define a first pivot axis A. One or more bolt assemblies 46 fasten the frame 42 to the conduit 24 such that the first pivot axis A is located substantially above the main opening 26. FIG. 1 illustrates that the frame assembly 40 comprises four hinge ears 44 and four bolt assemblies 46. A door surface 48 extends around the conduit opening 26.

The gate assembly 22 further comprises a door assembly 50 comprising a primary door assembly 52 and a secondary door assembly 54. The primary door assembly 52 comprises a primary door member 60 and one or more primary hinge members 62. Extending from the primary door member 60 are one or more primary hinge flanges 64 and one or more secondary hinge ears 66. The secondary hinge ears 66 define a second pivot axis B. The primary door member 60 defines a regulated opening 68.

FIG. 1 illustrates that the exemplary primary door assembly 52 comprises two primary hinge flanges 64 and two secondary hinge ears 66. The primary hinge flanges 64 are sized, dimensioned, and located to fit between the frame hinge ears 44. FIG. 1 also shows that the primary hinge members 62 extend through aligned holes in the frame hinge ears 44 and primary hinge flanges 64. The primary hinge members 62 secure the primary door member 60 to the frame 42 for rotation about the first pivot axis A.

The perimeter of the door member 60 is sized and dimensioned to engage the door surface 48 of the frame 42 to form a boundary around the main opening 26 when in a closed position. If the regulated opening 68 is blocked under conditions that will be described in further detail below, the primary door member 60 substantially prevents the flow of fluid through the main opening 26 when held in the closed position.

In addition, as perhaps best shown in FIG. 2, the exemplary door surface 48 lies in a plane that is slightly angled with respect to true vertical. Accordingly, gravity holds the door member 60 against the door surface 48 in the absence of water pressure on either side of the door member 60.

FIG. 1 further shows that the cross-sectional area of the regulated opening 68 is smaller than the cross-sectional area of the main opening 26. The exact sizes, shapes, and proportions of the cross-sectional areas of the regulated and main openings 68 and 26 are not important to the principles of the present invention. Typically, these sizes and proportions will be determined based on the particular location and goals of a particular implementation of the gate system 20.

FIGS. 1 and 2 show that the secondary door assembly 54 comprises secondary door member 70, a regulation assembly 72, a plurality of secondary hinge members 74, and a door float 76. The door member 70 comprises a blocking portion 80, one or more lever portions 82, and one or more secondary hinge flanges 84. The door float 76 of the exemplary secondary door assembly 54 is a separate body that is secured to the blocking portion 80 of the secondary door member 70. However, the door float 76 may be implemented in other forms. For example, the door float 76 may be implemented as a sealed compartment integrally formed with the door float 76.

As shown in FIG. 1, the exemplary secondary door assembly 54 comprises four secondary hinge flanges 84. The secondary hinge flanges 84 are arranged in pairs that are sized, dimensioned, and located to extend on either side of the two secondary hinge ears 66. The secondary hinge members 74 extend through aligned holes in the secondary hinge ears 66 and secondary hinge flanges 84. The secondary hinge members 74 secure the secondary door member 70 to the primary door member 60 for rotation about the second pivot axis B. The blocking portion 80 and lever portions 82 are on opposite sides of the second pivot axis B such that blocking and lever portions 80 and 82 move in opposite directions as the secondary door member rotates about the second pivot axis B.

The secondary door member 70 is sized and dimensioned to extend around the regulated opening 68 in the primary door member 60 when in a closed position. The secondary door member 70 substantially prevents the flow of fluid through the regulated opening 68 when held in a closed position.

The exemplary regulation assembly 72 comprises one or more regulation floats 90, one or more float rods 92, an optional adjustment assembly 94, and a coupler yoke 96 and coupler pin 98 for each float rod 92. The float rods 92 connect the regulation floats 90 to the lever portions 82 of the secondary door member 70 through the coupler yokes 96 and coupler pins 98.

The optional adjustment assembly 94 allows a position of the regulation floats 90 on the float rods 92 to be altered to change a distance between the floats 90 and the lever portions 82. The coupler yokes 96 are rigidly connected to the float rods 92. The coupler pins 94 extend through the coupler yokes 96 and lever portions 82 to attach the float rods 92 to the lever portions 82. Other systems for connecting the regulation floats 90 to the lever portions 82 may be used in place of the float rods 92, coupler yokes 96, and coupler pins 98.

With the foregoing basic understanding of the construction of the gate system 20, the operation of the gate system 20 under typical conditions will now be described with reference to FIGS. 3–8.

The primary water level 34 on the first side 30 of the gate system 20 typically varies based on tidal action. In addition, weather, waves, boat wakes, and other transitory factors can affect the water level 34. In the following discussion, the operation of the gate system 20 will first be described in the context of a typical tide cycle without considering the effects of transitory factors. The effect of these transitory factors on the gate system 20 will be discussed briefly after the discussion of the typical tide cycle.

The secondary water level 36 on the second side 32 typically varies based on how much water has previously passed through the conduit 24 and on transitory factors such as rain, flooding, or the like. The secondary water level 36 is thus not typically cyclical but is usually at or near the level of the bottom of the main opening 26. In the following discussion of the operation of the gate system during a typical tide cycle, the secondary water level 36 is relevant only for a portion of the tide cycle as will be discussed further below. The secondary water level 36 is not relevant to the operation of the gate system 20 for much of the tide cycle and is not depicted in FIGS. 4–8.

Initially, when the water levels 34 and 36 are both below a main opening level L1 corresponding to the bottom of the main opening 26, gravity will bias the primary door member 60 into its closed position. Gravity also biases the secondary door member 70 into its closed position. In this case, the gate system 20 is in what will be referred to as the dormant state.

Figure 3:
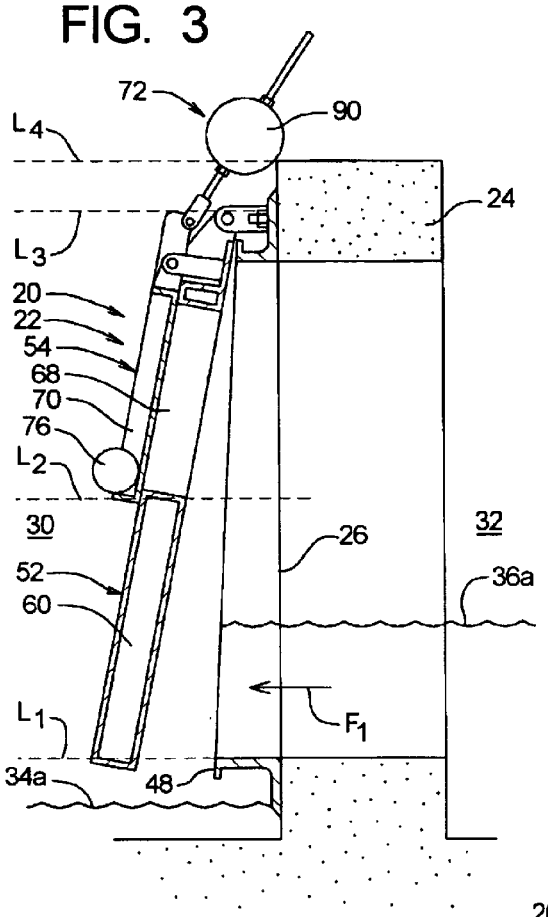
FIGS. 3–8 are side elevation views depicting various states of the tidal gate assembly of FIG. 1 throughout its cycle of operation.

Referring now to FIG. 3, in this case, a first primary water level 34*a* is below the main opening level L1. The situation depicted in FIG. 3 would correspond to low tide, and the secondary level 36 of the water on the second side 32 is relevant at this point. In particular, when a first secondary water level 36*a* exceeds the main opening level L1, the water on the second side 32 acts on the primary door member 60 as shown in FIG. 3. In this case, the water on the second side 32 will force the primary door member 60 into an open position as shown in FIG. 3. As shown by is reference character $F_1$ in FIG. 3, when the primary door member is in the open position, water flows from the second side 32 to the first side 30.

When the secondary body of water forces primary door member 60 into the open position, the gate system 20 in FIG. 3 is in what will be referred to herein as the drainage state. When the gate system 20 is in the drainage state, gravity maintains the secondary door member 70 in the closed position.

As the primary water level 34 rises, the water level 34 will eventually rise above the main opening level L1. If the gate system 20 is in the dormant state when the primary water level exceeds the main opening level L1, the water on the first side 30 will hold the primary door member 60 in the closed position.

If the gate system 20 is in the drainage state when the primary water level exceeds the main opening level L1, the water on the outer and second sides 30 and 32 will mix through the main opening 26 until the pressure of the water on the first side 30 eventually exceeds that of the water on the second side 32. At that point, the main body of water on the first side 30 will force the primary door member 60 into its closed position. At this point, the gate system 20 will be in what will be referred to as the first intermediate state, Water does not flow in either direction when the gate system 20 is in the first intermediate state. The secondary door member 70 is still in its closed position when the gate system is in the first intermediate state.

Figure 4:
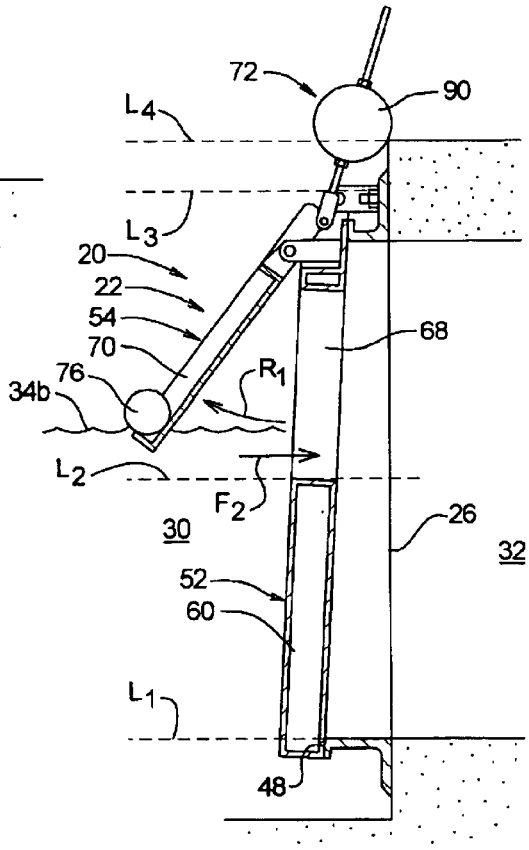
Figure 5:
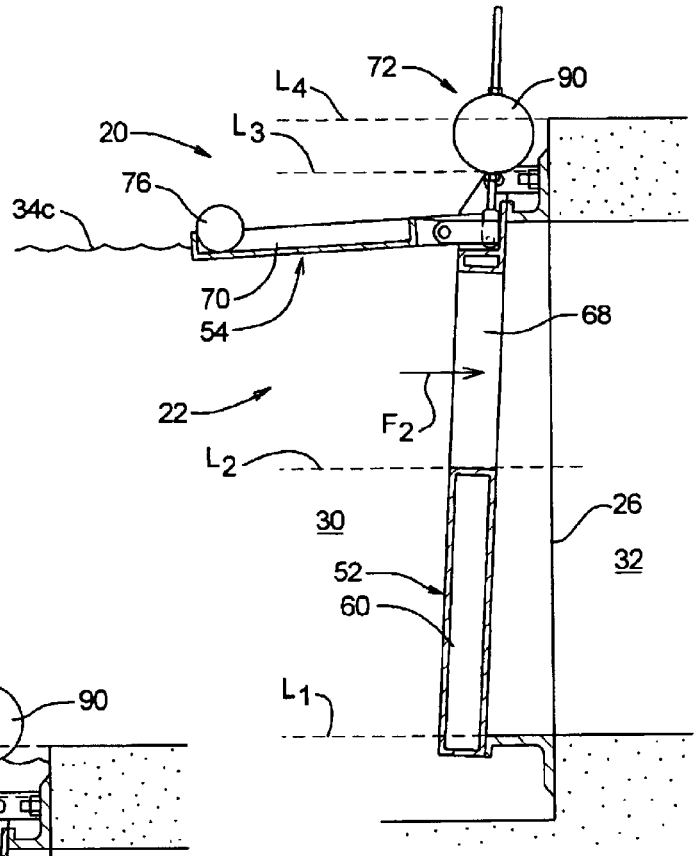

As the primary water level 34 continues to rise, it eventually exceeds a regulated opening level L2 defined by the bottom of the regulated opening 68. In particular, shown in FIGS. 4 and 5 are second and third primary water level 34*b* and 34*c* that exceed the regulated opening level L2. Under the conditions shown in FIGS. 4 and 5, the gate system 20 enters a second intermediate state in which the water on the first side 30 lifts the door float 76 and causes the secondary door member 70 to rotate out of the closed position as shown by arrow $R_1$ in FIG. 4.

The secondary door member 70 is shown partially open in FIG. 4 and fully open in FIG. 5.

As shown by reference character $F_2$ in FIG. 4, water flows from the first side 30 to the second side 32 through the regulated opening 26 when the gate system 20 is in the second intermediate state.

Figure 6:
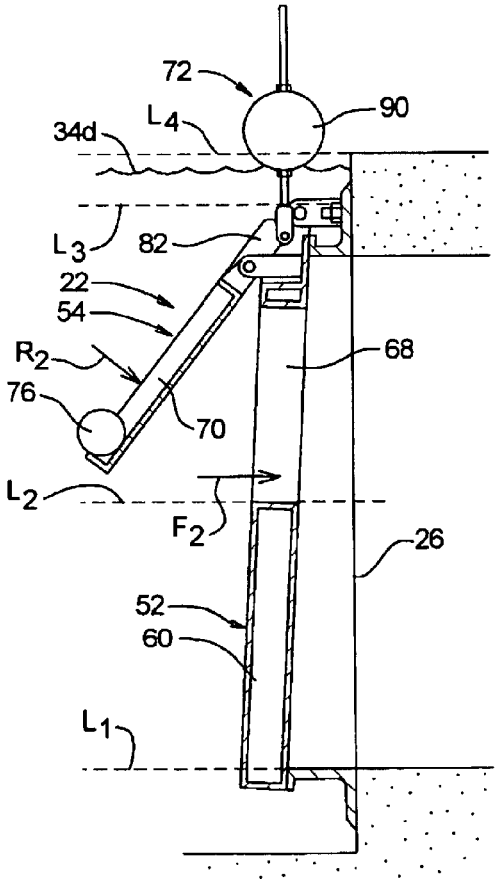

As the primary water level 34 continues to rise, the primary water level 34 eventually reaches a first regulation float level L3 determined by the regulation floats 90. When the primary water level 34 exceeds the first regulation float level L3, the gate system 20 enters what will be referred to as its active state. In the active state, as shown in FIG. 6 the floats 90 rotate the lever portions 82 up in one direction and thus the blocking portion 80 down about the second pivot axis in the opposite direction as shown by an arrow $R_2$. In the active state, the gate system 20 begins to restrict the flow of water from the first side 30 to the second side 32.

Figure 7:
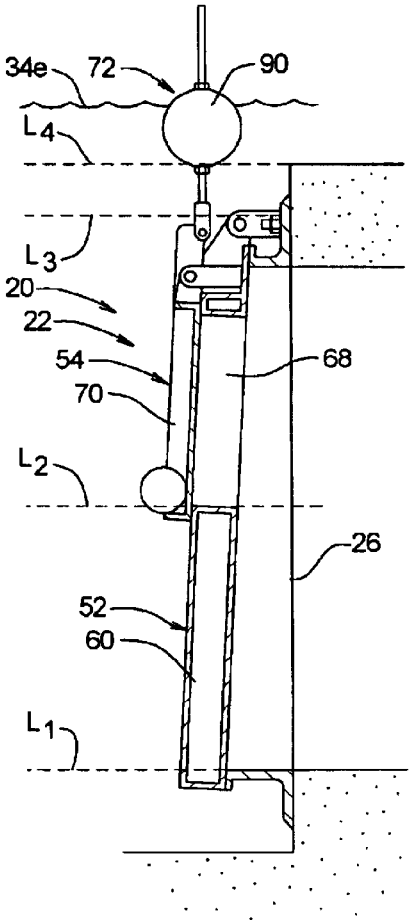
Figure 8:
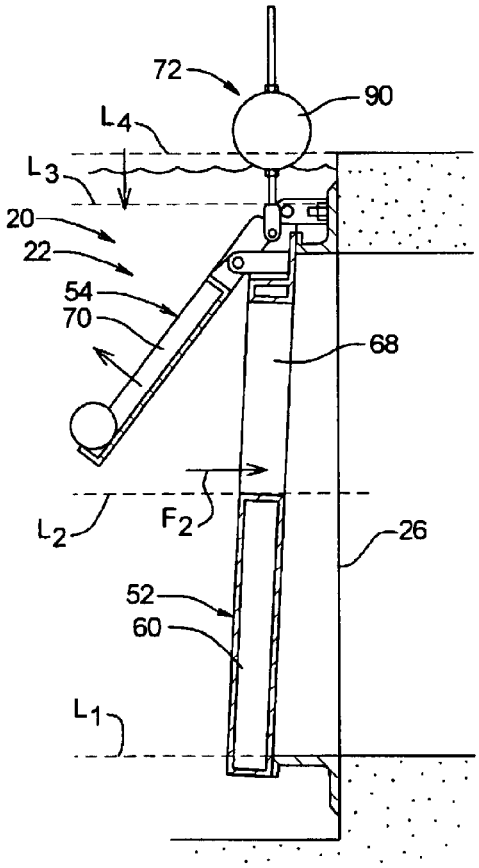

When the floats 90 reach a second regulation float level L4, the blocking portion 80 completely covers the regulated opening 68 such that secondary door member 70 is in its closed position as shown in FIG. 7. At this point, the gate system 20 is in what will be referred to as its closed state. When the gate system 20 is in its closed state, water no longer flows through the regulated opening 68 to the second side 32. The gate system 20 remains in the closed state as long as the primary water level 34 is at or above the second regulation float level L4.

The primary water level 34 begins to drop after reaching its highest level at high tide. As the primary water level 34 drops below the second regulation float level L4, the gate system 20 changes from its closed state to its active state. As the primary water level 34 continues to drop, with the gate system 20 in the active state, the secondary door member 70 moves out of its closed position, and the gate system 20 again allows water to flow from the first side 30 to the second side 32 through the regulated opening 68.

The primary water level 34 continues to drop until it falls below the first regulation float level L3. At this point, the gate system 20 changes from its active state to its second intermediate state in which the secondary door member 70 moves up and down with the primary water level 34.

As the primary water level 34 continues to drop, it eventually falls below the regulated opening level L2. At this point the gate system 20 enters its first intermediate state in which the primary door member 60 is open or closed depending upon the pressures of the water on the first side 30 and second side 32. As the primary water level 34 drops below the regulated opening level L2, the gate system 20 enters either its drainage state or its dormant state depending upon the secondary water level 36. After the primary water level 34 reaches its lowest point at low tide, the primary water level 34 begins to rise again, and the process repeats.

While the exact parameters of the various components and openings described above are important to a particular implementation of the gate system 20, these parameters are not important to the scope of the present invention. In general, the size, weight, and/or dimensions of the components and/or openings are selected to allow appropriate volumes of fluid to flow between the outer and second sides 30 and 32 for a given location under expected conditions.

In addition, as generally described above, the gate system 20 will be exposed to transitory changes in the primary water level 34 caused by waves and the like. While these transitory changes may create some uncertainty as the gate system 20 changes from one state to another, once the gate system 20 is in a given state, moderate transitory changes in the primary water level 34 are unlikely to have a significant effect on the gate system 20. In addition, the effects of such transitory changes in primary water level 34 can be minimized by adjusting design criteria such as the masses of the primary door member 60 and secondary door member 70.

Figure 9:
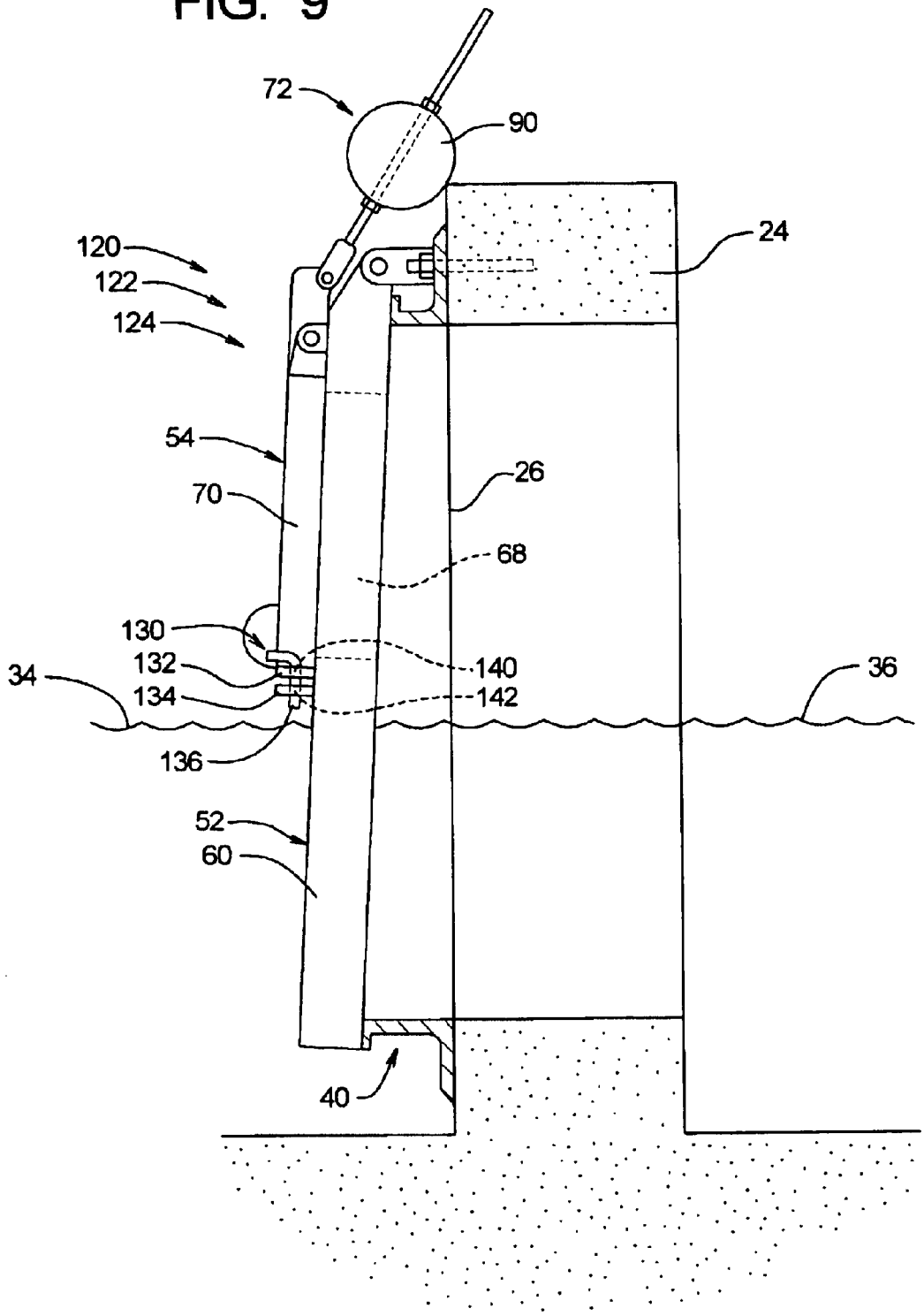
FIG. 9 is a side elevation view of a tidal gate assembly of a second embodiment of the present invention.

Turning now to FIG. 9 of the drawing, depicted therein is a gate system 120 of a second embodiment of the present invention. The gate system 120 is in most respects the same as the gate system 20 described above and will be described herein only to the extent that the system 120 differs from the system 20. The reference characters used above with respect to the gate system 20 will be used to identify corresponding elements of the gate system 120.

Like the gate system 20, the gate system 120 comprises a frame assembly 40 mounted onto a conduit 24 and a gate assembly 122 supported by the frame assembly 40. The gate assembly 122 comprises a door assembly 124 comprising a primary door assembly 52 comprising a primary door member 60 and a secondary door assembly 54 comprising a secondary door member 70. A regulation assembly 72 allows the gate system 120 to operate in an active state as discussed above.

Unlike the gate system 20, the door assembly 124 of the gate system 120 further comprises a lock system 130 for securing the secondary door member 70 in its closed position relative to the primary door member 60. The lock system 130 comprises first and second lock flanges 132 and 134 and a lock pin 136. When the secondary door member 70 is in its closed position relative to the primary door member 60, holes 140 and 142 in the lock flanges 132 and 134 are aligned. Inserting the lock pin 136 through the aligned holes 140 and 142 prevents movement of the secondary door member 70 out of its closed position relative to the primary door member 60.

The lock system 130 thus allows the operator of the gate system 120 to lock the gate system 120 into its closed state as described above and prevent the gate system 120 from entering its second intermediate or active states.

Turning now to FIGS. 10–15 of the drawing, depicted therein is a gate system 220 of a third embodiment of the present invention. The gate system 220 comprises a gate assembly 222 mounted on a conduit 224. The gate assembly 222 regulates the flow of water through an opening 226 defined by the conduit 224.

Figure 11:
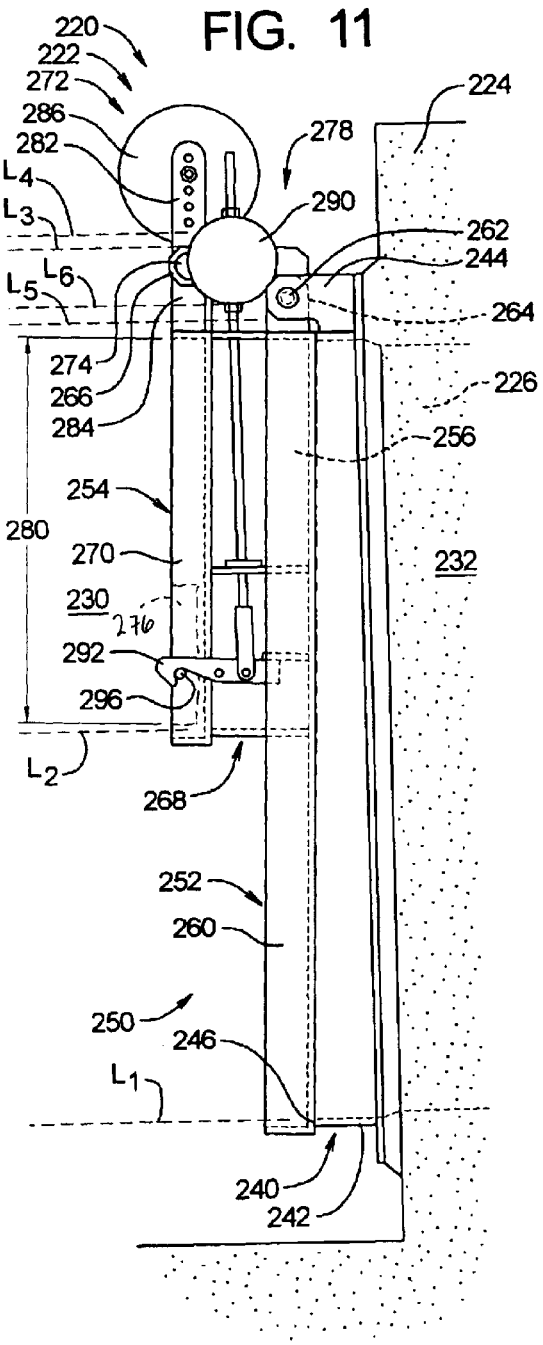
FIGS. 11–15 are side elevation views depicting various states of the tidal gate assembly of FIG. 10 throughout its cycle of operation.

The gate assembly 222 defines a first side 230 and a second side 232. As shown in FIG. 11, a primary body of water represented by a primary water level 234 is located on the first side 230 of the gate assembly 222. A secondary body of water represented by a water level 236 may be located on the second side 232 of the gate assembly 222. The purpose of the gate assembly 222 is to regulate the flow of water between,the primary and secondary bodies of water.

The gate assembly 222 comprises a frame assembly 240 comprising a frame 242. One or more frame hinge ears 244 extend from the frame 242 to define a first pivot axis A. The frame 242 is adhered to the conduit 224 by any suitable fastener such that the first pivot axis A is located substantially above the main opening 226. A door surface 246 extends around the conduit opening 226, and a seal 248 is arranged adjacent to the door surface 246.

The gate assembly 222 further comprises a door assembly 250 comprising a primary door assembly 252 and a secondary door assembly 254. The primary door assembly 252 defines a secondary opening 256. The primary door assembly 252 comprises a primary door member 260 and one or more primary hinge members 262. Extending from the primary door member 260 are one or more primary hinge flanges 264 and one or more secondary hinge ears 266. The secondary hinge ears 266 define a second pivot axis B. The primary door assembly 252 further comprises a secondary door housing 268 that extends from the primary door member 260 and surrounds the secondary opening 256. An optional seal 248b may be arranged on the housing 268 around the secondary opening 256.

The primary hinge flanges 264 are sized, dimensioned, and located to be arranged such that the primary hinge members 262 extend through aligned holes in the frame hinge ears 244 and primary hinge flanges 264. The primary hinge members 262 secure the primary door member 260 to the frame 242 for rotation about the first pivot axis A.

The perimeter of the door member 260 is sized and dimensioned to engage the door surface 246 of the frame 242 to form a boundary around the main opening 226 when in a closed position. The seal 248 reduces flow of water between the door surface 246 and the door member 260 when the primary door member 260 is in its closed position. Accordingly, if the regulated opening 256 is closed under conditions that will be described in further detail below, the primary door member 260 substantially prevents the flow of fluid through the main opening 226 when held in the closed position.

In addition, as perhaps best shown in FIG. 11 the exemplary door surface 246 lies in a plane that is slightly angled with respect to true vertical. Accordingly, gravity holds the door member 260 against the door surface 246 in the absence of water pressure on either side of the door member 260.

Figure 10:
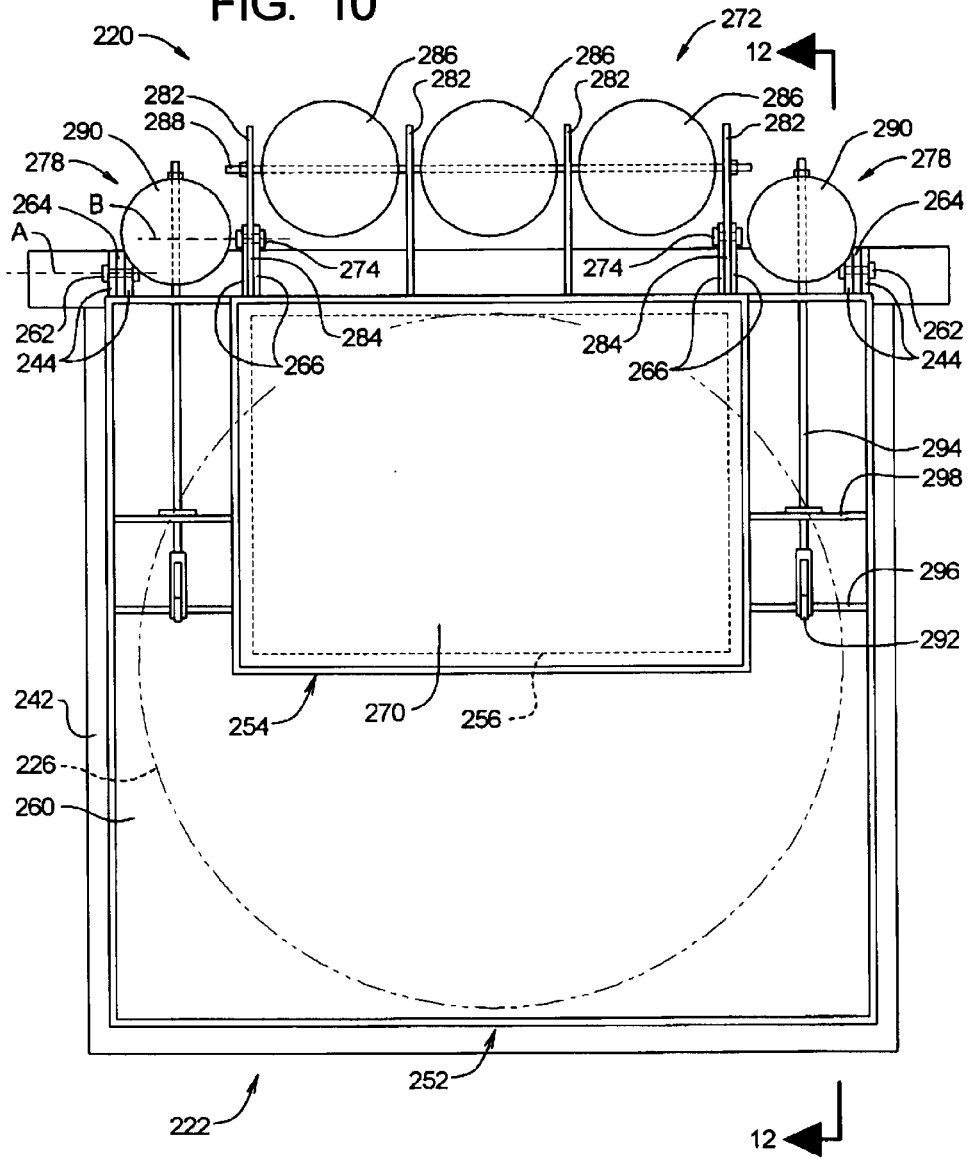
FIG. 10 is a front elevation view of a tidal gate assembly of a third embodiment of the present invention.

FIG. 10 further shows that the cross-sectional area of the regulated opening 256 is significantly smaller than the cross-sectional area of the main opening 226. The exact sizes, shapes, and proportions of the cross-sectional areas of the regulated and main openings 256 and 226 are not important to the principles of the present invention. Typically, these sizes, shapes, and proportions will be determined based on the particular location and goals of a particular implementation of the gate system 220.

FIGS. 10 and 11 show that the secondary door assembly 254 comprises secondary door member 270, a regulation assembly 272, a plurality of secondary hinge members 274, a door float defined by a float chamber 276, and a latch system 278. The door member 270 comprises a blocking portion 280, one or more lever portions 282, and one or more secondary hinge flanges 284. As described above, the gate system 220 does not employ a separate float member. Instead, the float chamber 276 is integrally formed with the blocking portion 280 of the secondary door member 270 such that the secondary door member 270 opens with the rising tide in a manner similar to that of secondary door member 270 described above.

As shown in FIG. 10, the secondary hinge flanges 284 are sized, dimensioned, and located such that the secondary hinge members 274 extend through aligned holes in the secondary hinge ears 266 and secondary hinge flanges 284. The secondary hinge members 274 secure the secondary door member 270 to the primary door member 260 for rotation about the second pivot axis B. The blocking portion 280 and lever portions 282 are on opposite sides of the second pivot axis B such that blocking and lever portions 280 and 282 move in opposite directions as the secondary door member rotates about the second pivot axis B.

The secondary door member 270 is sized and dimensioned to extend around the regulated opening 256 in the primary door member 260 when in a closed position. The secondary door member 270 substantially prevents the flow of fluid through the regulated opening 256 when held in a closed position.

The exemplary regulation assembly 272 comprises one or more regulation floats 286 and a float rod 288. The float rod 288 extends through holes in the regulation floats 286 and the lever portions 282 of the secondary door member 270 to connect the regulation floats 286 to the lever portions 282. A vertical position of the regulation floats 286 relative to the second pivot axis B can be adjusted by inserting the float rod 288 through different sets of holes in the lever portions 282. Other systems for connecting the regulation floats 286 to the lever portions 282 may be used.

Figure 12:
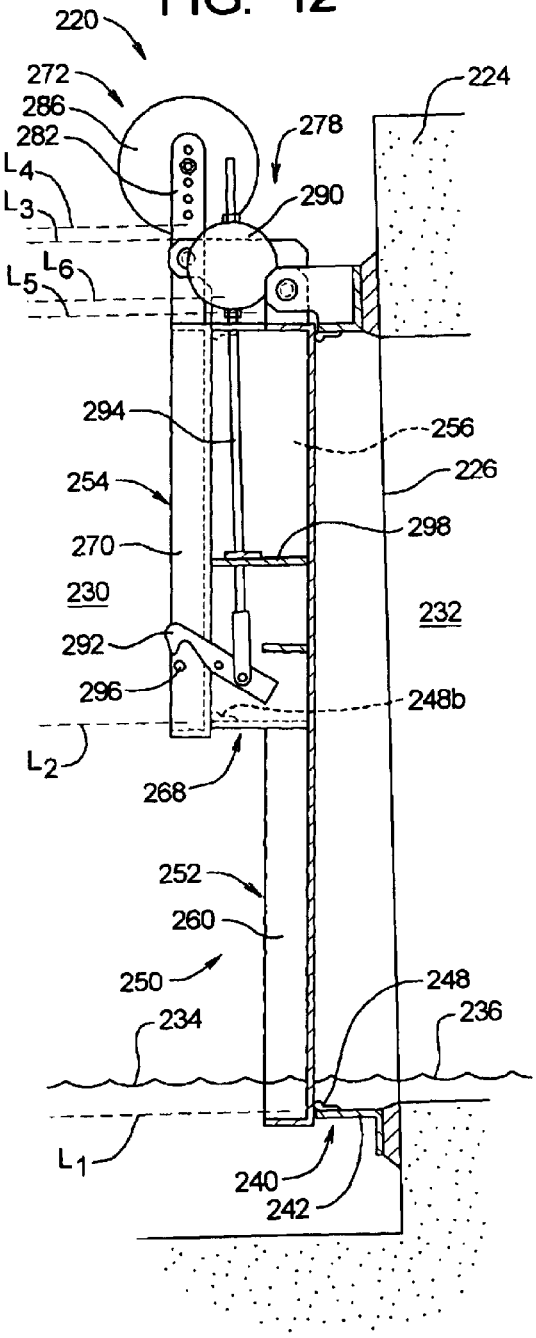
Figure 13:
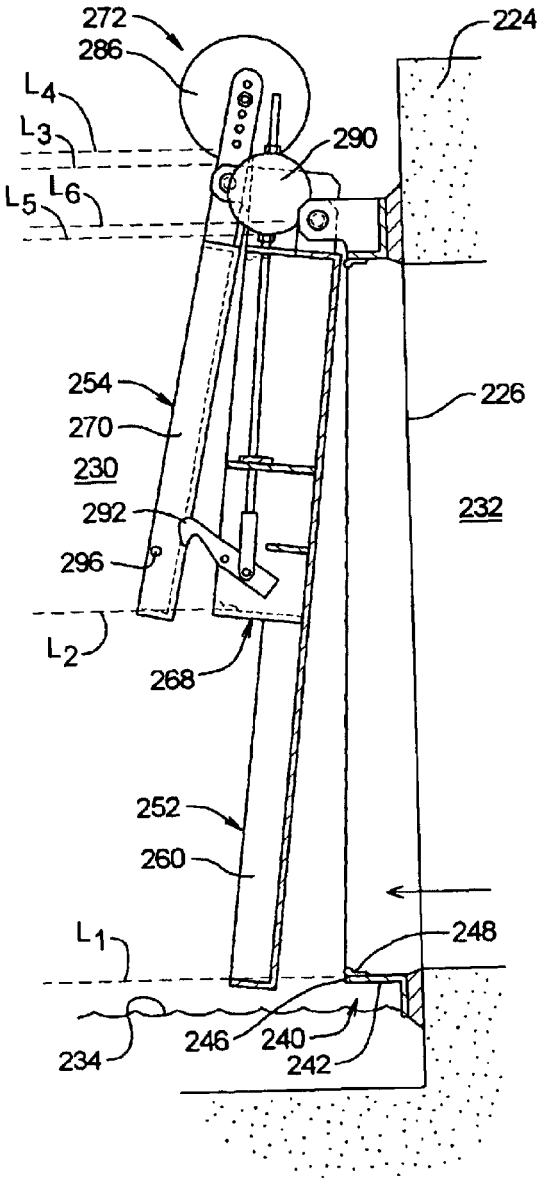
Figure 14:
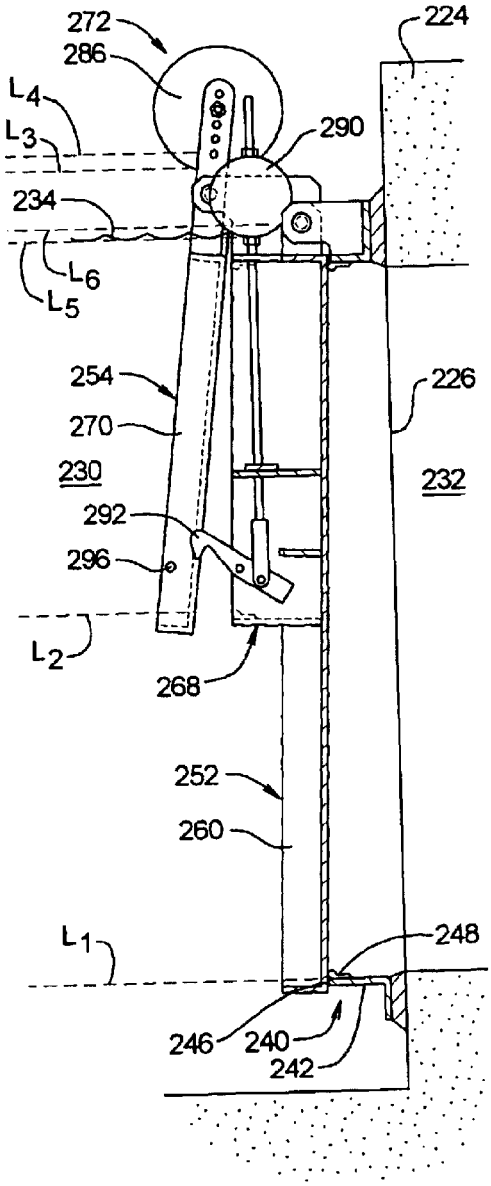
Figure 15:
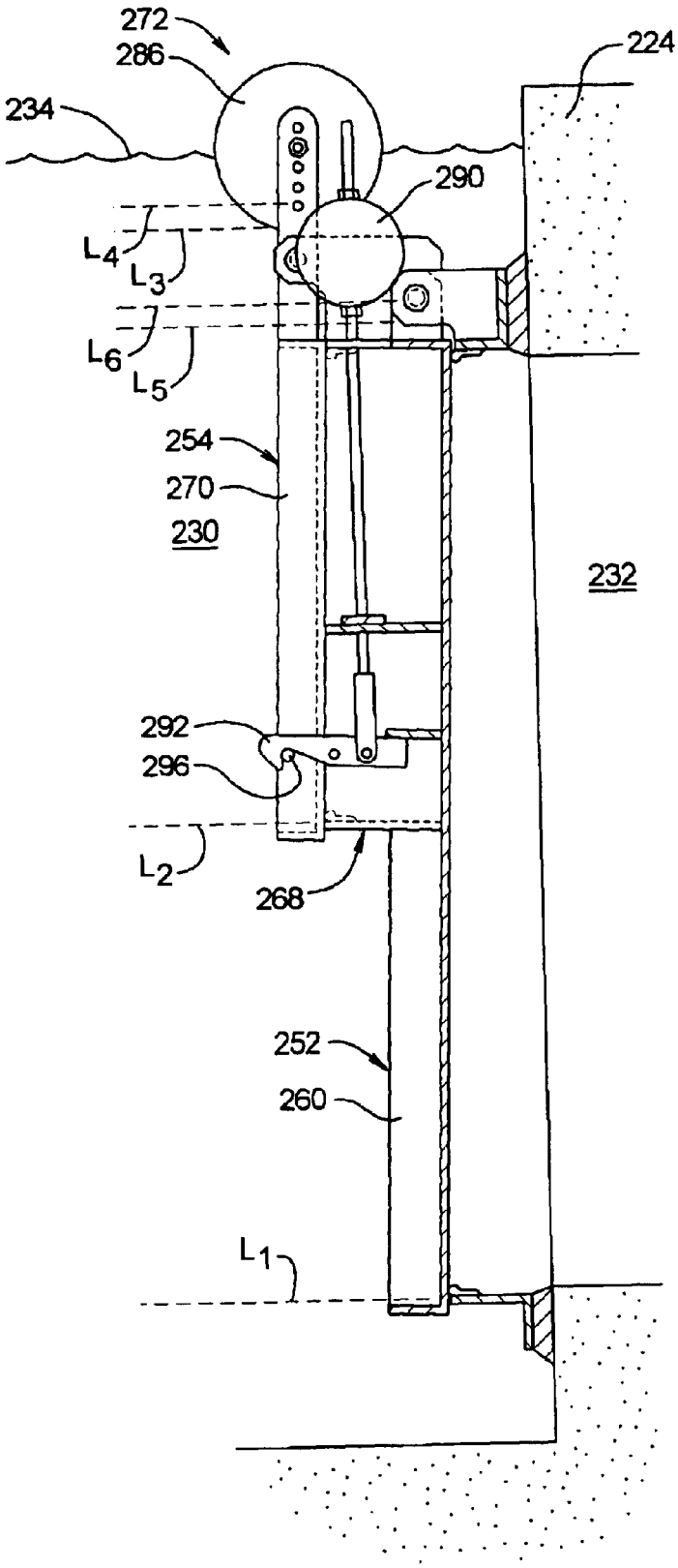

As perhaps best shown in FIGS. 10 and 12, the latch system 278 comprises one or more latch floats 290, one or more latch members 292, a latch rod 294 for each latch member 292, a latch pin 296 extending from the secondary door member 270, and one or more brace flanges 298 for supporting each of the latch rods 294.

The latch members 292 are rotatably attached to the secondary door housing 268 such that latch members 292 rotate between unlatched (FIG. 12) and latched (FIG. 11) positions. The brace flanges 298 support the latch rods 294 for movement between upper (FIG. 11) and lower (FIG. 12) positions. The latch floats 290 are secured to the latch rods 294 and the latch rods 294 are secured to the latch members 292 such that vertical movement of the latch floats 290 between the lower and upper positions causes rotational movement of the latch members 292 between the unlatched and latched positions, respectively.

When the latch members 292 are in the latched position, the latch members 292 are capable of engaging the latch pins 296 and holding the secondary door member 270 in its closed position. Further, with the latch members 292 in the latched position, the secondary door member 270 can rotate into its closed position. The latch members 292 hold the secondary door member 270 in its closed position as long as the latch members 292 stay in the latched position.

More specifically, the latch members 292 are shaped like a conventional garden gate latch. As with a garden gate latch, the force of the secondary door member 270 moving into its closed position causes the latch pins 296 to momentarily place the latch members 292 into their unlatched position to allow the secondary door member 270 to close. After the door member 270 closes, the latch floats 290 return the latch members 292 to their latched position.

During use of the gate system 220, the weight of the latch floats 290 forces the latch members 292 into the unlatched position when the primary water line 234 is below a first latch float level L5 determined by the latch float 290 in its lowermost position (FIG. 12).

When the primary water line 234 reaches the first latch float level L5 (FIG. 14), the latch float 290 begins to raise and force the latch members 292 towards the latched position. When the primary water line 234 exceeds a second latch float level L6 defined by the uppermost position of the latch float 290 (FIG. 15), the latch float 290 holds the latch members 292 into the latched position.

For much of the tide cycle, the gate system 220 regulates fluid flow between the outer and second sides 230 and 232 in a manner similar to that of the gate system 20 described above. In particular, the gate system 220 regulates fluid in substantially the same manner as the gate system 20 as the primary water level 234 moves up through and above the main opening level L1, regulated opening level L2, first regulation float level L3, and second regulation float level L4, and then drops back to the second regulation float level L4.

However, as described above, the latch system 278 holds the secondary door member 270 in its closed position when the primary water level 234 is above the second latch float level L6. Accordingly, as the primary water level 234 drops below the second regulation float level L4, the gate system 220 enters a latched mode in which the latch system 278 holds the secondary door member 270 in its closed position even though the regulation float 286 is no longer afloat.

The gate system 220 remains in the latched mode until the primary water level 234 drops below the first latch float level L5. At this point, gravity returns the latch members 292 to the unlatched positions, and the gate system 220 returns to the first intermediate mode. The gate system 220 then operates in the same manner as the gate system 220 for the remainder of the tide cycle.

The latch system 278 thus enables the gate system 220 to operate in a latched state to limit the flow of water through the regulated opening 256 to a volume less than that obtainable using the system 20 described above.

Any of the gate systems 20, 120, and 220 described above can thus be tailored to fit a particular location and environment. The relative sizes and shapes of the main openings and regulated openings of these systems can be altered to obtain desired flow rates in either direction. In addition, the absolute vertical heights of the various levels L1–L4 can be selected with relation to each other as desired.

When desirable, the gate system 220 having a latch system may be used, with the first and second latch float levels L5 and L6 defined thereby selected in relation to the float levels L1–L4 defined by the other components of the gate system. However, the gate systems 20 and 120 are less complex and expensive and typically will be used when further regulation based on the first and second latch float levels L5 and L6 is not required.

Given the foregoing, it should be clear to one of ordinary skill in the art that the present invention may be embodied in forms other than those described above. The scope of the present invention should be determined by the following claims and not the foregoing detailed description.

We claim:

1. A tidal gate system for a regulating the flow of tidal waters between a first side and a second side of a main opening, the tidal gate system comprising:

a primary door member arranged for movement between open and closed positions relative to the main opening, where gravity biases the primary door member into its closed position, and the primary door member defines a regulated opening;

a secondary door member arranged for movement between open and closed positions relative to the primary door assembly, where gravity biases the secondary door member into its closed position, and the secondary door member covers the regulated opening when in its closed position;

a door float configured to cause the secondary door assembly to move out of its closed position when a primary water level on the first side of the main opening exceeds a predetermined regulated opening level; and a regulation float, where the regulation float is operatively connected to the secondary door assembly such that the regulation float forces the secondary door assembly into its closed position when the primary water level exceeds a predetermined regulation float level.

2. A tidal gate system as recited in claim 1, further comprising a latch system for latching the secondary door member in its closed position under predetermined conditions.

3. A tidal gate system as recited in claim 2, in which the latch system comprises:

a latch member attached to the main door member for movement between latched and unlatched positions, where the latch member is arranged to hold the secondary door member in its closed position when the latch member is in its latched position; and a latch float operatively connected to the latch member such that the latch float moves the latch member into its unlatched position when the primary water level exceeds a predetermined latch float level.

4. A tidal gate system as recited in claim 3, in which the predetermined latch float level is below the predetermined regulation float level.

5. A tidal gate system as recited in claim 1, further comprising a lock system for locking the secondary door member into its closed position.

6. A tidal gate system as recited in claim 5, in which the lock system comprises:

a first lock flange secured to the primary door member;

a second lock flange secured to the secondary door member; and a lock member that extends through the first and second latch flanges to lock the secondary door member in its closed position.

7. A tidal gate system as recited in claim 2, further comprising a lock system for locking the secondary door member into its closed position.

8. A tidal gate system as recited in claim 1, in which the primary opening defines a primary opening level, where the primary opening level is located below the regulated opening level.

9. A tidal gate system as recited in claim 1, in which secondary door member comprises:

a blocking portion sized and dimensioned to cover the regulated opening; and a lever portion operatively connected to the regulation float; where the second door member rotates about a pivot axis relative to the primary door member; and the blocking portion and lever portion are arranged on opposite sides of the pivot axis such that movement of the regulation float causes movement of the lever portion and movement of the lever portion causes movement of blocking portion.

10. A tidal gate system as recited in claim 1, further comprising an adjustment assembly that allows the regulation float level to be adjusted.

11. A method of a regulating the flow of tidal waters between a first side and a second side of a main opening, the method comprising the steps of:

arranging a primary door member for movement between open and closed positions relative to the main opening such that gravity biases the primary door member into its closed position;

forming a regulated opening in the primary door member;

arranging a secondary door member for movement between open and closed positions relative to the primary door assembly such that gravity biases the secondary door member into its closed position and the secondary door member covers the regulated opening when in its closed position;

connecting a door float to the secondary door member to cause the secondary door assembly to move out of its closed position when a primary water level on the first side of the main opening exceeds a predetermined regulated opening level; and connecting a regulation float to the secondary door assembly such that the regulation float forces the secondary door assembly into its closed position when the primary water level exceeds a predetermined regulation float level.

12. A method as recited in claim 11, further comprising the steps of latching the secondary door member in its closed position under predetermined conditions.

13. A method as recited in claim 12, in which the step of latching the secondary door member comprises the steps of:

attaching a latch member to the main door member for movement between latched and unlatched positions such that the latch member is arranged to hold the secondary door member in its closed position when the latch member is in its latched position; and connecting a latch float to the latch member such that the latch float moves the latch member into its unlatched position when the primary water level exceeds a predetermined latch float level.

14. A method as recited in claim 13, further comprising the step of configuring the regulation float and the latch float such that the predetermined latch float level is below the predetermined regulation float level.

15. A method as recited in claim 11, further comprising the step of locking the secondary door member into its closed position.

16. A method as recited in claim 15, in which step of locking the secondary door member into its closed position comprises the steps of:

securing a first lock flange to the primary door member;

securing a second lock flange to the secondary door member; and passing a lock member through the first and second latch flanges when the secondary door member is in its closed position.

17. A method as recited in claim 11, further comprising the steps of:

defining a blocking portion of the secondary door member, where the blocking portion is sized and dimensioned to cover the regulated opening; and defining a lever portion of the secondary door member;

connecting the lever portion to the regulation float;

arranging the second door member for rotation about a pivot axis relative to the primary door member; and arranging the blocking portion and the lever portion on opposite sides of the pivot axis such that movement of the regulation float causes movement of the lever portion and movement of the lever portion causes movement of blocking portion.

18. A method as recited in claim 11, further comprising the step of adjusting the regulation float level defined by the regulation float.

19. A tidal gate system for a regulating the flow of tidal waters between a first side and a second side of a main opening, the tidal gate system comprising:

a primary door member arranged for movement about a first pivot axis between open and closed positions relative to the main opening, where the first pivot axis is arranged above the main opening such that gravity biases the primary door member into its closed position, and the primary door member defines a regulated opening;

a secondary door member arranged for movement about a second pivot axis between open and closed positions relative to the primary door assembly, where the secondary door member defines a blocking portion and a lever portion, and the second pivot axis is arranged between the blocking portion and the lever portion such that gravity biases the secondary door member into its closed position in which the blocking portion covers the regulated opening;

a door float operatively connected to the secondary door assembly such that the secondary door assembly moves out of its closed position when a primary water level on the first side of the main opening exceeds a predetermined regulated opening level; and a regulation float operatively connected to the lever portion of the secondary door assembly such that the regulation float forces the secondary door assembly into its closed position when the primary water level exceeds a predetermined regulation float level.

20. A tidal gate system as recited in claim 19, further comprising:

a latch member attached to the main door member for movement between latched and unlatched positions, where the latch member is arranged to hold the secondary door member in its closed position when the latch member is in its latched position; and a latch float operatively connected to the latch member such that the latch float moves the latch member into its unlatched position when the primary water level exceeds a predetermined latch float level.

21. A tidal gate system as recited in claim 19, further comprising:

a first lock flange secured to the primary door member;

a second lock flange secured to the secondary door member; and a lock member that extends through the first and second latch flanges to lock the secondary door member in its closed position.

* * * * *